US007063242B2

(12) United States Patent
Marti et al.

(10) Patent No.: US 7,063,242 B2
(45) Date of Patent: Jun. 20, 2006

(54) REFRACTORY POURING SPOUT AND CHANNEL UNIT FOR THE ARRANGEMENT ON AN OUTLET OF A VESSEL CONTAINING MOLTEN METAL, ESPECIALLY THE TUNDISH OF A STRIP CASTING INSTALLATION

(75) Inventors: Heinrich Marti, Forch (CH); Jacques Barbé, Tarantaise (FR)

(73) Assignees: SMS Demag AG, Düsseldorf (DE); Main Management Inspiration AG, Hergiswil (CH)

( * ) Notice: Subject to any disclaimer, the term of this patent is extended or adjusted under 35 U.S.C. 154(b) by 338 days.

(21) Appl. No.: 10/312,375

(22) PCT Filed: Jun. 27, 2001

(86) PCT No.: PCT/EP01/07351

§ 371 (c)(1),
(2), (4) Date: Aug. 22, 2003

(87) PCT Pub. No.: WO02/00372

PCT Pub. Date: Jan. 3, 2002

(65) Prior Publication Data

US 2004/0041311 A1 Mar. 4, 2004

(30) Foreign Application Priority Data

Jun. 28, 2000 (CH) ..... 1277/00

(51) Int. Cl.
*B22D 11/06* (2006.01)
*C21C 5/42* (2006.01)

(52) U.S. Cl. ..... 222/594; 222/606; 266/236

(58) Field of Classification Search ..... 266/236; 222/594, 606

See application file for complete search history.

(56) References Cited

U.S. PATENT DOCUMENTS

| | | | | |
|---|---|---|---|---|
| 5,733,469 A | | 3/1998 | Damasse et al. | |
| 5,794,682 A | | 8/1998 | Damasse et al. | |
| 5,840,206 A | | 11/1998 | Gacher et al. | |
| 5,857,514 A | * | 1/1999 | Shook et al. | 222/594 |
| 6,095,233 A | * | 8/2000 | Leabeater et al. | 222/606 |

FOREIGN PATENT DOCUMENTS

FR 2777485 10/1999

OTHER PUBLICATIONS

Patent Abstracts of Japan, vol. 013, No. 555, Dec. 11, 1989 & JP 01 228649 A (Nippon Steel Corp), Sep. 12, 1989.
Patent Abstracts of Japan, vol. 009, No. 142, Jun. 18, 1985 & JP 60 021171 A (Nitsushin Seikou KK), Feb. 2, 1985.

* cited by examiner

*Primary Examiner*—Scott Kastler
(74) *Attorney, Agent, or Firm*—Friedrich Kueffner

(57) ABSTRACT

A refractory pouring spout and channel unit for the arrangement on the outlet of a tundish of a strip casting installation has at least one vertical, refractory pouring spout and channel part (25) which can be connected to the tundish; and a refractory pouring spout and channel part (25') which originates from said vertical part, which extends horizontally and which is provided with one or more openings that are distributed over its length. This results in almost constant laminar flow conditions for the melt flowing between the casting rollers.

10 Claims, 6 Drawing Sheets

REFRACTORY POURING SPOUT AND CHANNEL UNIT FOR THE ARRANGEMENT ON AN OUTLET OF A VESSEL CONTAINING MOLTEN METAL, ESPECIALLY THE TUNDISH OF A STRIP CASTING INSTALLATION

BACKGROUND OF THE INVENTION

1. Field of the Invention

The invention pertains to a refractory pouring spout and channel unit for installation at the outlet of a vessel containing molten metal, especially at the outlet of the tundish of a strip casting machine, where the pouring spout and channel unit has at least one vertical, refractory pouring spout and channel part, which can be connected to the tundish, and a horizontal refractory pouring spout and channel part, which originates from the vertical part and is provided with one or more openings distributed over its length.

2. Description of the Related Art

In a known strip casting machine according to the publication FR-A-2 753,402, a distribution vessel is arranged above the casting rolls, and a ladle is arranged above the vessel. In this case a pouring spout and channel provided at the outlet of the ladle projects into the distribution vessel, which has its own outlet and nozzle directed at the gap between the casting rolls. In addition, a stopper rod is provided in the ladle to control the discharge of the molten metal. The disadvantage here is that, when the distribution vessel is full, the ferrostatic level is relatively high, which causes the discharge rate to be high as well. Thus, as a result of the molten metal flowing between the casting rolls, the quantity of molten metal flowing in is not constant, and the bath formed between the casting rolls becomes agitated to a corresponding degree.

The publication JP-A-01-228,649 (Abstract and Drawings) describes a refractory pouring spout and channel unit which is installed on a tundish and which is immersed in the molten bath located between two casting rolls. The pouring spout and channel unit consists of an outlet, which is connected to the tundish, and an immersion tube, which surrounds the outlet. The immersion tube consists of a pouring spout and channel part extending in the horizontal direction, which is provided with several openings for the molten metal distributed over its length. The immersion tube has a longitudinal chamber in its interior, and underneath the chamber there are two elongated distribution bores, which are connected to each other via openings. Slots proceed upward at a slant from the elongated bores; the molten metal arriving in the immersion tube from the outlet enters the molten metal bath between the casting rolls through these slots. The disadvantage of this pouring spout and channel unit is that, because of the selected design, the molten metal has a relatively large amount of kinetic energy as it emerges. It can be seen that the flow of molten metal is supposed to be directed toward the surface of the casting rolls, from which it is deflected into the molten metal bath, as a result of which it is possible under certain conditions for damage to occur to the cast shell of the poured strip.

SUMMARY OF THE INVENTION

Against the background of this state of the art, the task on which the invention is based is to design a pouring spout and channel unit in such a way that the molten metal arrives in the area between the casting rolls with the smallest possible amount of kinetic energy as a uniform, laminar flow so that the surface of the bath which forms between the casting rolls remains as level as possible. In addition, the pouring spout and channel unit is also to be designed so that the molten metal is distributed as uniformly as possible over the entire length of the casting rolls and so that the steel skin of the strip formed on the two rolls extends over the entire width of the rolls at a constant thickness.

The task is accomplished according to the invention in that the several openings distributed over the length of the horizontal pouring spout and channel part are arranged toward the top, a certain distance away from the bottom end, so that a sump is formed in the pouring spout and channel part.

With this pouring spout and channel unit according to the invention, it is ensured that the molten metal is distributed uniformly between the casting rolls and also that it flows slowly, so that the surface of the bath also remains calm. This makes a considerable contribution to the satisfactory casting performance of the strip-casting machine.

It is advantageous for the horizontal pouring spout and channel part to have an approximately rectangular, triangular, polygonal, round, semi-circular, or similar cross section, from both sides of which and also preferably from the ends of which the openings proceed.

In an embodiment of the pouring spout and channel unit according to the invention, it is provided that the elongated pouring spout and channel part is mounted independently of the vertical pouring spout and channel part on a separate suspension, and that the one pouring spout and channel part projects into the other pouring spout and channel part.

An advantageous embodiment of the pouring spout and channel unit is characterized in that one or more drain openings are provided at the bottom the channel, so that the molten metal can be emptied out at the end of the pouring operation. It is advantageous here for the lateral sealing elements of the pouring spout and channel unit to be provided with drain openings also.

BRIEF DESCRIPTION OF THE DRAWINGS

Exemplary embodiments of the invention and additional advantages offered by it are explained in greater detail below on the basis of the drawings.

DETAILED DESCRIPTION OF THE INVENTION

Figure 1:
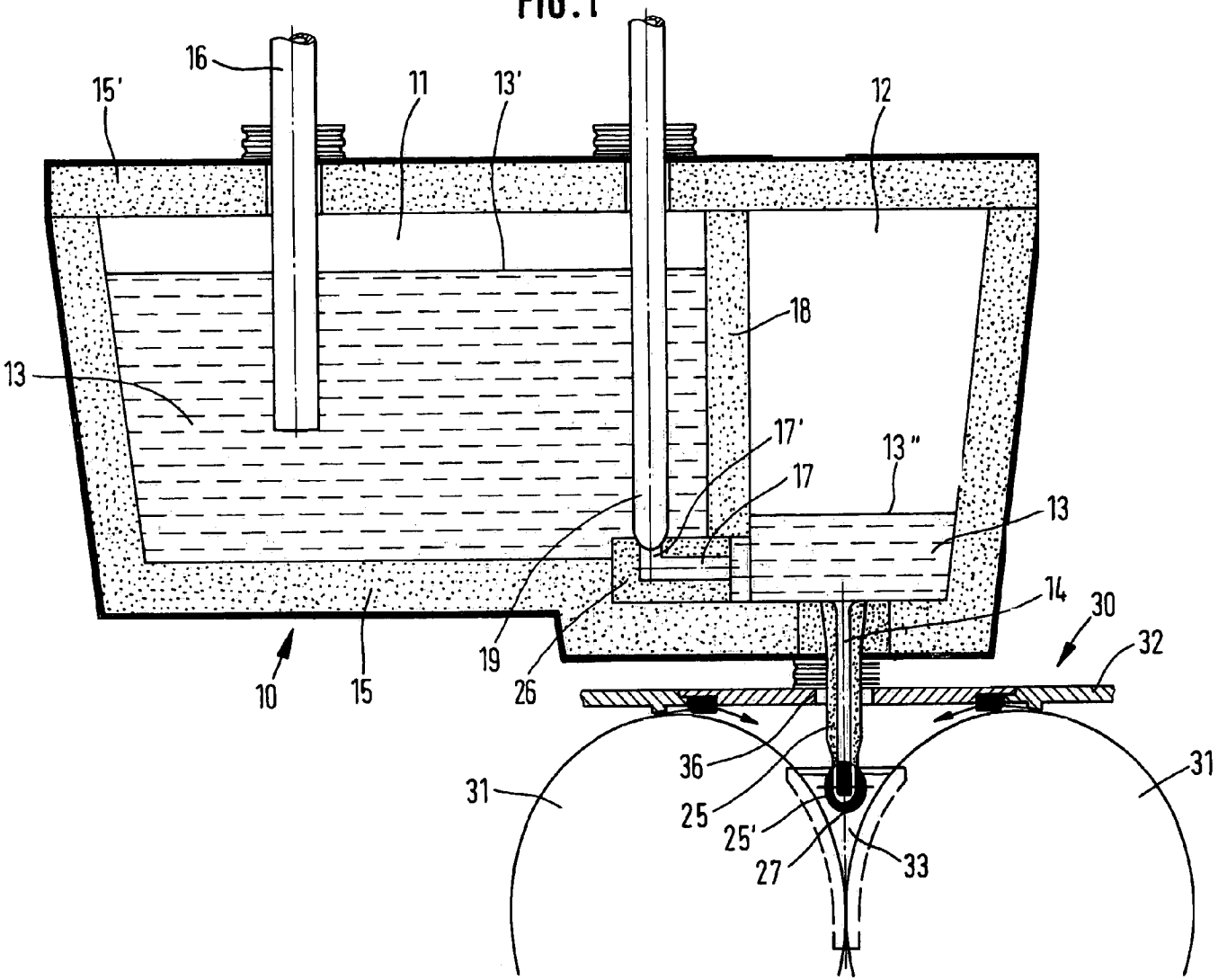
FIG. 1 shows a longitudinal cross section of a tundish and a pouring spout and channel unit according to the invention.

FIG. 1 shows a refractory-lined tundish 10 for the pouring of molten metal into a strip-casting machine 30 known in and of itself, by means of which very thin steel strips only a few millimeters thick but with a width of up to 2 meters can be produced. The only parts of the strip-casting machine 30 shown are the casting rolls 31 and the housing box 32 surrounding them.

The tundish 10 has a cover 15', an interior space to hold the molten metal 13, and an outlet 14 in the bottom. The molten metal 13 is added through an immersion tube 16, which extends into the tundish 10, this tube being connected to the outlet of a ladle (not shown). A pouring spout and channel 25 forming the outlet 14 projects into the molten bath 33 between the rotating casting rolls 31. It is advantageous for the interior space of the tundish 10 to be filled with inert gas. Between the tundish 10 and the housing cover 32, furthermore, there is a bellows 36, which surrounds the pouring spout and channel 25.

The interior of the tundish is divided into at least two chambers 11, 12, which are connected to each other by a pass-through opening 17. The molten metal 13 can be loaded into the one chamber 11, whereas the other chamber 12 is provided with the outlet 14; the quantity of molten metal flowing from the first chamber 11 to the second chamber 12 can be adjusted by means of a control valve 19 installed at the pass-through opening 17.

It is advisable to provide a vertical partition wall 18 in the interior of the tundish, which is advantageously located in an off-center position, so that the loading chamber 11 is two-to-three-times larger than the chamber 12 with the outlet.

It is highly advantageous for the level of the bath 13" in the chamber 12 with the outlet 14 to be lower during the pouring operation than the level of the bath 13' in the loading chamber 11; it is preferably maintained at a level of 10–50% of the height of the other bath. Thus, precisely in the lower area of the pouring spout and channel, it is possible for the kinetic energy of the through-flowing molten metal to be held to a very low level and thus to achieve constant laminar flow conditions.

It is advisable for the control valve 19, designed as a stopper rod, to be actuated in such a way that the height of the molten metal bath in chamber 12 with the outlet 14 is kept uniform during the pouring operation. The level can advantageously be adjusted by means of a suitable control element and a measuring device for determining the height of the bath. It would also be possible to provide either a rotary seal, a sliding seal, or some other type of seal as the control valve.

The inlet 17' to the nozzle 26 forming the pass-through opening 17 is offset in the upward direction with respect to the bottom of the loading chamber 11 of the tundish. This offers the advantage that any inclusions which may arrive in the chamber from the ladle will settle at the bottom and not proceed onward to the following chamber 12.

The invention is characterized by the refractory pouring spout and channel unit 25, 25', several design variants of which are explained in the following. This pouring spout and channel unit consists at least of a vertical pouring spout and channel part 25, which is embedded in the bottom of the tundish, and a separate, elongated pouring spout and channel part 25', which proceeds from the first part and extends in the horizontal direction. This tubular pouring spout and channel part 25' is provided with several openings 27 distributed over its length a certain distance away from, and extending approximately along the length of, the casting rolls 31.

Figure 2:
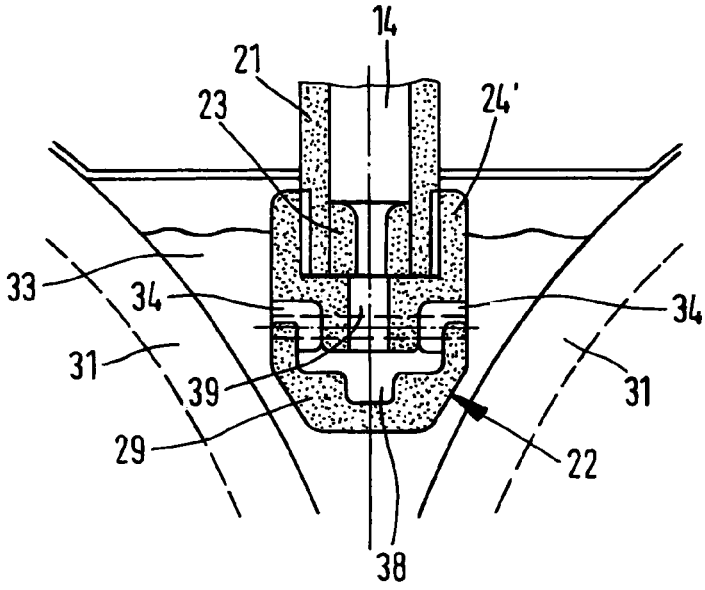
FIG. 2 shows a cross section through a pouring spout and channel unit between the suggested casting rolls.
Figure 3:
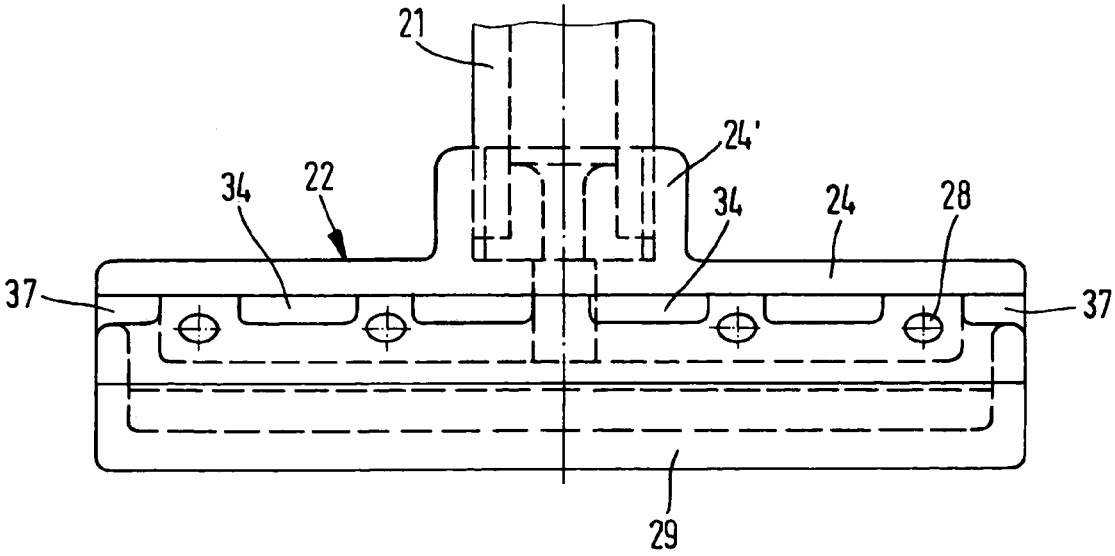
FIG. 3 shows a side view of the pouring spout and channel unit according to FIG. 2.

FIGS. 2 and 3 illustrate a refractory pouring spout and channel unit, which has a vertical pouring spout and channel part 21, projecting down and away from the bottom of the tundish, with an inner metering nozzle 23., and a box-like pouring spout and channel part 22, attached to the vertical part. The box-like part is advantageously long enough to supply the molten metal bath 33 with so-called "hot melt" all the way to the outside edges at the lateral seals to prevent parasitic solidifications. The pouring spout and channel part 22 is built out of two separate components for manufacturing reasons, the upper, cover-like part 24 being provided with a flange 24' for attachment to the pouring spout and channel part 21. The lower, shell-like part 29 is attached to the upper part by means of the pins 28, especially refractory bolts, which are merely suggested in the drawing.

This pouring spout and channel part 22 forms an elongated channel 38, which is connected to the central inlet opening 39, and which is provided with groove-like openings 34, 37, leading out from it on both sides and from the ends. These several openings 34, which are spaced uniformly along the length of the channel, are, within the scope of the invention, located near the top, a certain distance away from the bottom, so that, first, the molten metal emerging from these openings 34 flows upward at a slant and so that, second, the channel 38 forms a kind of sump, where any solid particles which may be in the molten metal can settle. The additional advantage is thus obtained that the molten metal flowing into this channel 38 is first distributed over its entire length and only then emerges at an approximately uniform rate from the openings 34.

Figure 4:
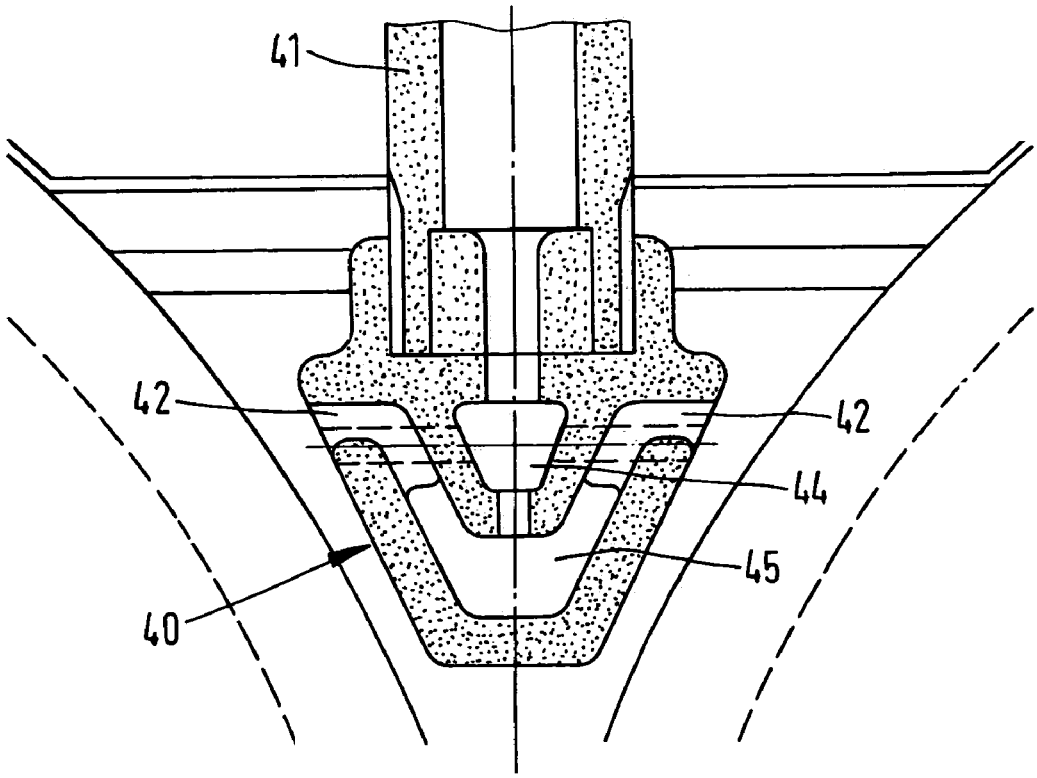
FIG. 4 shows a cross section of a variant of a pouring spout and channel unit between the suggested casting rolls.
Figure 5:
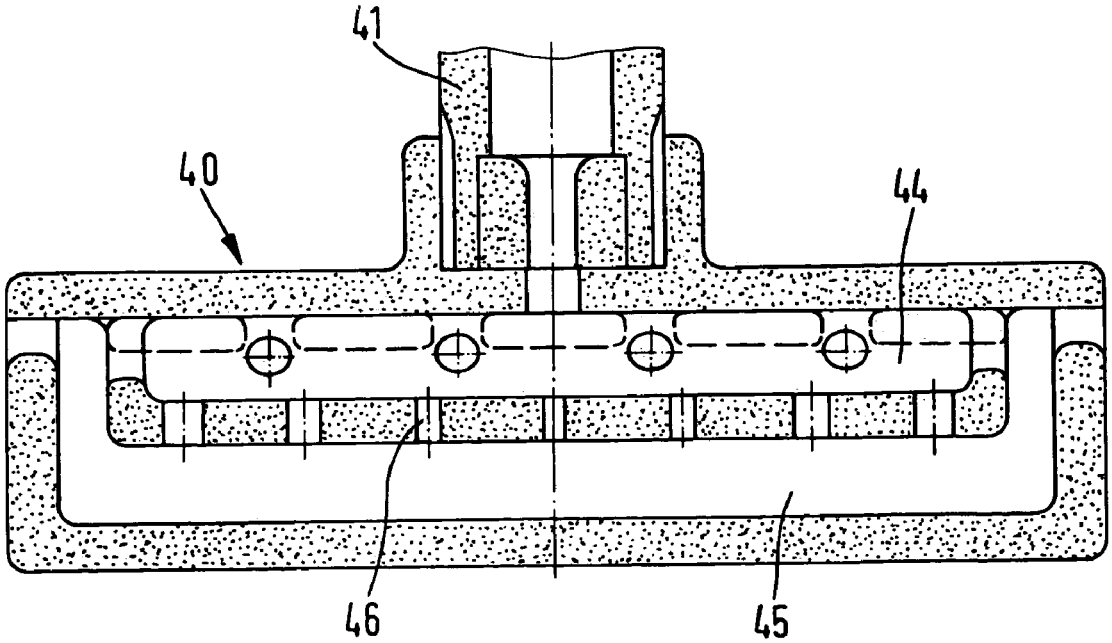
FIG. 5 shows a side view of the pouring spout and channel unit according to FIG. 4.

FIGS. 4 and 5 show a pouring spout and channel unit similar to that of FIG. 2. Only the differences, therefore, will be explained in the following. In the case of this pouring spout and channel unit, an upper 44 longitudinal channel and a lower longitudinal channel 45 are provided in the part 40, which channels are connected to each other by vertical bores 46 distributed over the length of the channels, the diameters of the bores 46 toward the outside being larger than those toward the inside. This first longitudinal channel 44 has the effect of throttling the flow of molten metal before it can flow into the second channel 45 and escape through the outlet openings 42, which are themselves offset toward the top.

Figure 6:
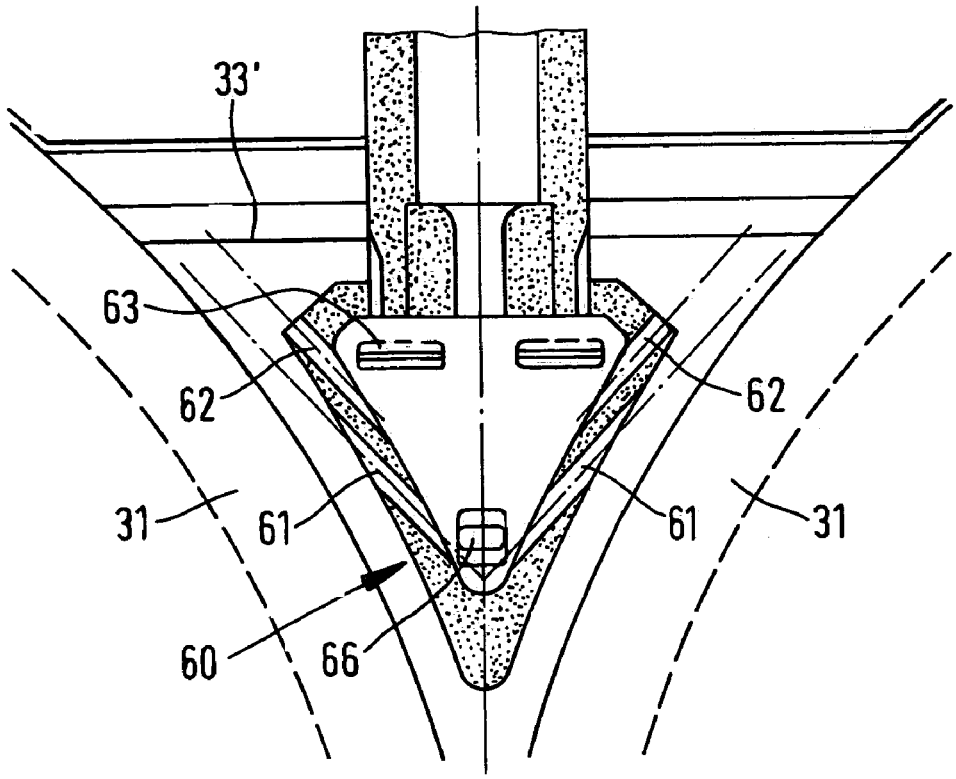
FIGS. 6 and 7 show cross sections of variants of a pouring spout and channel unit.

In the case of the pouring spout and channel unit according to FIG. 6, the outlet openings 61, 62 in the V-shaped pouring spout 60 are oriented with an upward slant of up to 60° to the horizontal. A lower and an upper row of these openings 61, 62 are provided. As a result, the molten metal flows out with an upward slant in a direction approximately tangential to the associated casting roll 31. In addition, openings 63, 66 are also present in the ends of this pouring spout and channel part 60. With this design, the part 60 can be positioned deep in the bath, and the openings 61, 62 ensure optimum distribution of the molten metal without causing the surface 33' of the bath to become agitated.

Figure 7:
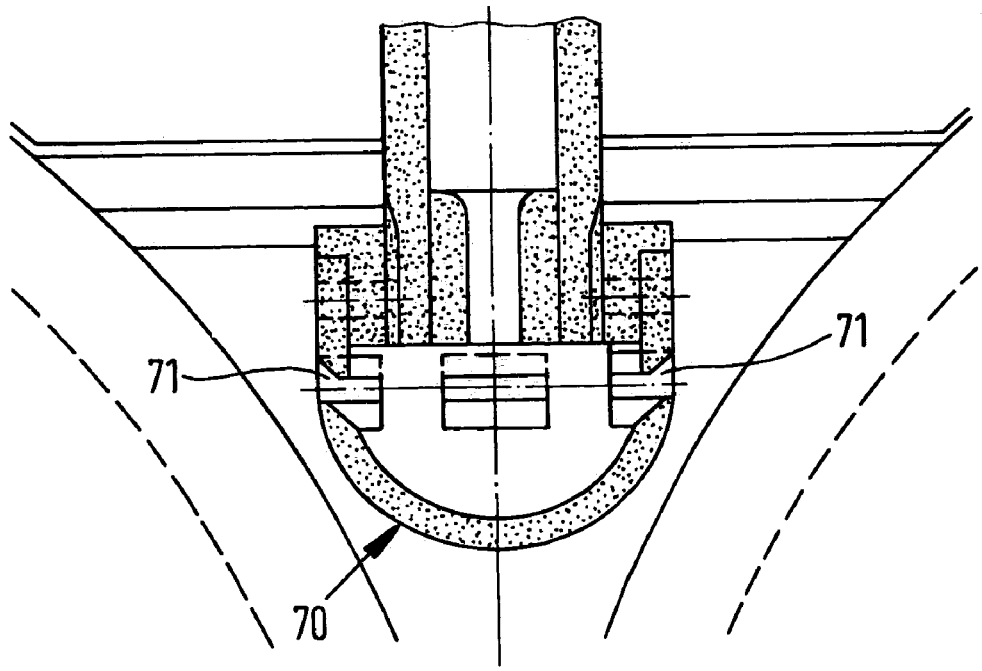

According to FIG. 7, the . . . 70, again made as two parts, is provided with a semicircular cross section. The openings 71 are arranged on the sides with an offset in the upward direction, so that the same advantageous effects as those previously described are obtained again.

In principle, all of the openings 71 could be arranged to point vertically downward, or some of them could point downward while the rest would be located along the sides.

The essential point here is that the newly incoming material should not cause any local erosion on the skin of the strip being formed.

Figure 8:
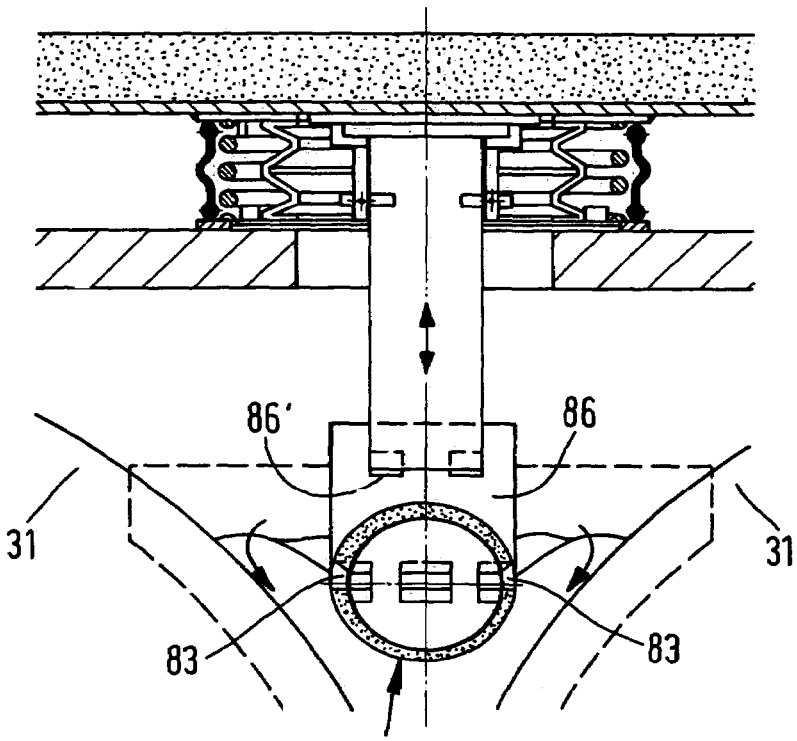
FIG. 8 shows a partial cross section through a design variant of a pouring spout and channel unit.
Figure 9:
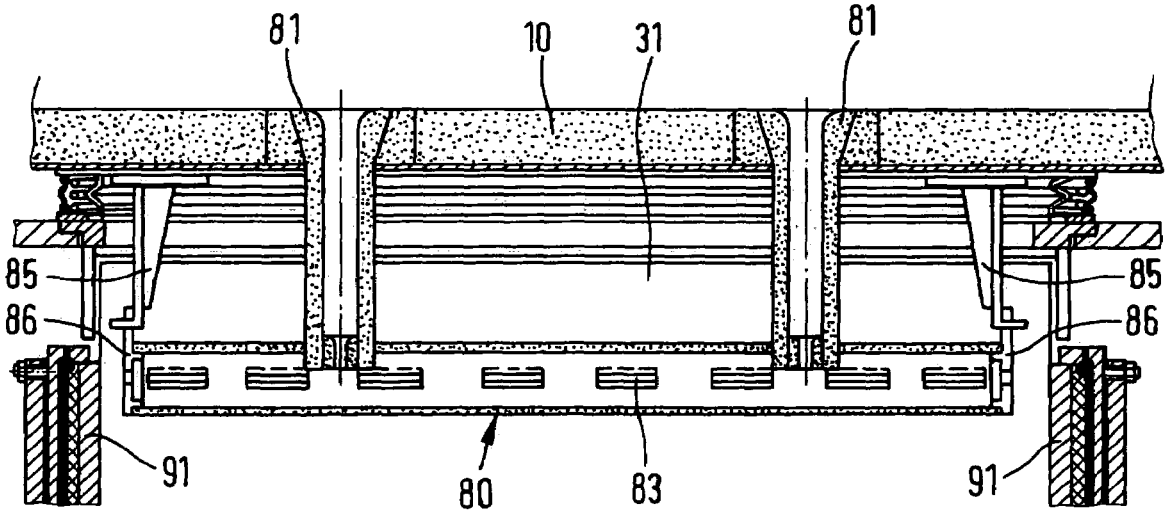
FIG. 9 shows a cross section through a pouring spout and channel unit according to FIG. 8 with indication of the casting rolls and the lateral seals.

FIGS. 8 and 9 show a variant of a pouring spout and channel unit, in which, in contrast to the examples presented above, the elongated pouring spout and channel part 80 is not mounted on the vertical pouring spout and channel part 81 but rather on a separate suspension 85. The suspension 85 is attached in this case to the bottom of the tundish 10. In addition, two vertical pouring spout and channel units 81 of conventional design are provided, which are embedded in the tundish 10 a certain distance from each other and project into the . . . 80. If the rolls are not too wide, it is also possible to work with only a single pouring spout and channel unit.

The tubular pouring spout and channel part 80 has several lateral openings 83 and, on each of the end surfaces, an extended sealing cover 86, in which holes 86' are provided, with which the suspension 85 engages. The pouring spout and channel part 80 has approximately the same length as the casting rolls 31, the lateral seals 91 of which are shown in FIG. 9. Thus it is possible to produce this pouring spout and channel unit very easily without having to accept engineering shortcomings.

Figure 10:
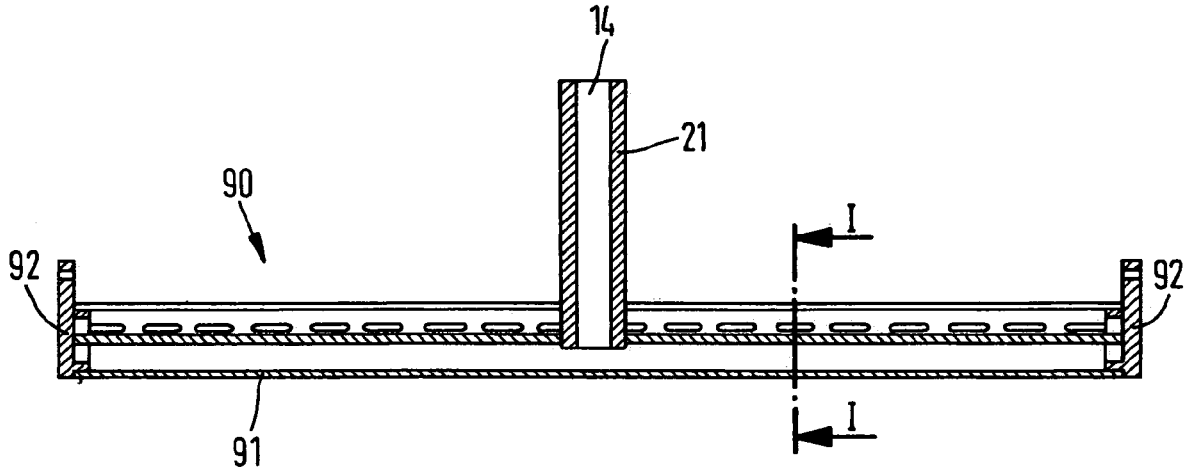
FIG. 10 shows a longitudinal cross section through a design variant of a pouring spout and channel unit.
Figure 11:
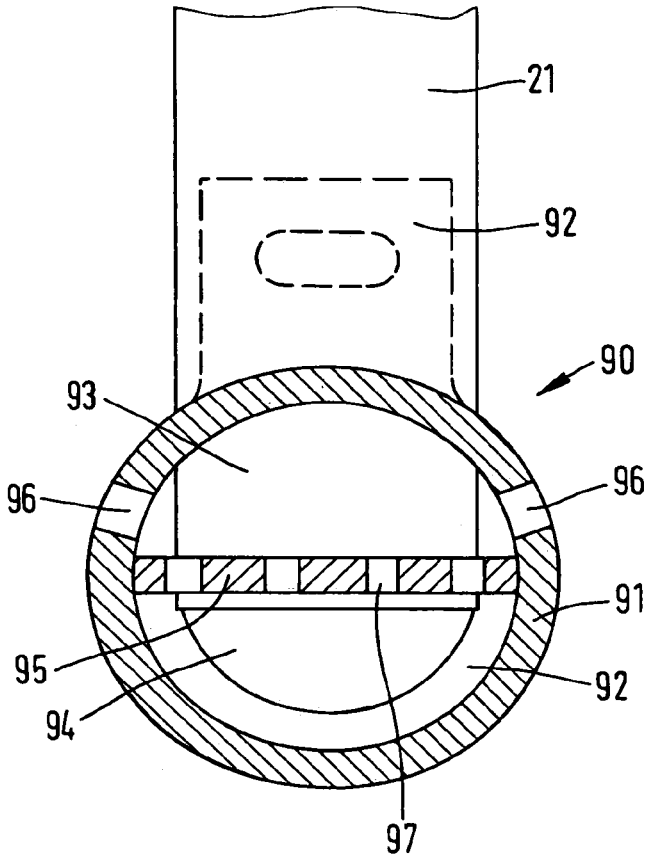
FIG. 11 shows a cross section through the pouring spout and channel unit according to FIG. 10 along line I—I.

FIGS. 10 and 11 show another highly advantageous variant of a pouring spout and channel unit, in which the elongated pouring spout and channel part 90 consists of a horizontal refractory tube 91 with a sealing element 92 and a partition wall 95 at each end. A partition wall 95 located approximately in the center of the tube 91 divides the tube into an upper chamber 93 and a lower chamber 94, which are connected to each other by openings 97, such as bores, slots, or the like, which are arranged in rows extending along the entire length of the partition wall.

Approximately in the middle of the tube 91, the pouring spout and channel part 21 projects through the tube and through the partition wall 95 to open out into the lower chamber 94.

This pouring spout and channel unit is designed so that the molten metal flows first from the tundish through the opening 14 of the pouring spout and channel part 21 and into the lower chamber 94. As soon as the chamber 94 is full, the molten metal rises through the openings 97 into the upper chamber 93, and from there it flows through openings 96 in the boundary walls of the upper chamber. The molten metal can thus exit in the proper direction between the two casting rolls.

So that the sump of the molten metal to be poured which forms in the chamber 94 can be emptied at the end of the pouring operation, it is advantageous to provide several openings in the bottom of the tube 91. The sealing elements 92 can also be provided with corresponding openings.

The invention is sufficiently disclosed by means of the exemplary embodiments explained above. It would be possible, however, for the invention to be embodied in other variants.

The pouring spout and channel parts could also be designed as two-part or multi-part units, and the tube-shaped parts could also be assembled from appropriate tube-shaped segments.

The invention claimed is:

1. A refractory pouring spout and channel unit f or installation at an outlet of a vessel containing molten metal, especially at an outlet of a tundish of a strip-casting machine, the refractory pouring and channel unit comprising at least one vertical refractory pouring spout and channel part adapted to be connected to the tundish, and, proceeding from the vertical refractory pouring spout and channel part, a horizontal refractory pouring spout and channel part having one or more openings distributed over the length of the horizontal refractory pouring spout and channel part, wherein the one or more openings are distributed over a length of the horizontal refractory pouring spout and channel part, so that they are located toward the top and a certain distance away from the bottom, so that a sump is formed the in pouring spout and channel part, wherein an elongated pouring spout and channel part is divided by a partition wall into an upper and a lower chamber, wherein the outlet of the vertical pouring spout and channel part opens into the lower chamber, and wherein the partition wall has openings following a partition wall through which the molten metal, after entering the lower chamber, rises into the upper chamber and flow out from the upper chamber through openings in the boundary walls of the upper chamber.

2. The refractory pouring spout and channel unit according to claim 1, wherein the horizontal pouring spout and channel part is separate from the vertical pouring spout and channel part, and wherein the vertical pouring spout and channel part projects into the horizontal part.

3. The refractory pouring spout and channel unit according to claim 2, wherein the horizontal pouring spout and channel part and the vertical pouring spout and channel part are attached to each other.

4. The refractory pouring spout and channel unit according to claim 1, wherein the several openings distributed over the length of the pouring spout and channel part are slots for causing the molten metal to flow outwardly at a slant and/or upwardly in an approximately vertical direction.

5. The refractory pouring spout and channel unit according to claim 1, wherein the horizontal pouring spout and channel part has one of an approximately rectangular, triangular, polygonal, round and semi-circular cross-section, and wherein at least one elongated channel is formed in the horizontal pouring spout and channel part, wherein the several openings distributed over the length of the pouring spout and channel part are slots designed such that they cause the molten metal to flow outwardly at a slant and/or upwardly in approximately vertical direction.

6. The refractory pouring spout and channel unit according to claim 1, wherein the horizontal pouring spout and channel part has an approximately rectangular, triangular, polygonal, round, semi-circular, cross-section, and wherein at least elongated channel is formed in the horizontal pouring spout and channel part, wherein the openings lead away on both sides and from the ends.

7. The refractory pouring spout and channel unit according to claim 5, wherein the horizontal pouring spout and channel part has upper and lower longitudinal channels, wherein the channels are connected to each other through vertical bores distributed along the length of the channels.

8. The refractory pouring spout and channel unit according to claim 1, wherein the elongated pouring spout and channel part is mounted on a separate suspension independently of the vertical pouring spout and channel part, and wherein one of the pouring spout and channel parts projects into the other pouring spout and channel part.

9. The refractory pouring spout and channel unit according to claim 1, wherein a bottom of the tube has one or more drain openings, such that the molten metal can flow out at the end of the casting operation.

10. The refractory pouring spout and channel unit according to claim 1, wherein sealing elements of the elongated pouring spout and channel part have drain openings in an area of the tube, such that the molten metal can flow out at the end of casting operation.

* * * * *